US005802877A

United States Patent [19]

Yates et al.

[11] Patent Number: 5,802,877

[45] Date of Patent: Sep. 8, 1998

[54] CIRCULAR KNITTING MACHINE FOR MAKING A SOCK WITH A KNITTED TOE POCKET

[75] Inventors: James Wallace Yates, Wise, Va.; George Timothy Hicks, Walnut Cove, N.C.

[73] Assignees: James W. Yates; Ronnie L. Yates

[21] Appl. No.: 799,440

[22] Filed: Feb. 13, 1997

[51] Int. Cl.[6] ..... D04B 9/46; A41B 11/00

[52] U.S. Cl. ..... 66/21; 66/173; 66/95; 66/185; 2/239

[58] Field of Search ..... 66/173–178 R, 66/180, 184, 185, 186–187, 13–17, 95, 20, 21, 22, 23, 40, 41, 215, 216, 222, 226, 8; 2/239

[56] References Cited

U.S. PATENT DOCUMENTS

| | | | |
|---|---|---|---|
| 1,152,850 | 9/1915 | Scott . | |
| 2,757,526 | 8/1956 | Crawford . | |
| 2,861,440 | 11/1958 | Crawford . | |
| 3,021,699 | 2/1962 | Crawford . | |
| 3,181,313 | 5/1965 | Crawford et al. . | |
| 3,605,446 | 9/1971 | Crawford, Jr. et al. . | |
| 4,005,494 | 2/1977 | Burn . | |
| 4,038,699 | 8/1977 | Burn . | |
| 4,961,235 | 10/1990 | Williger . | |
| 5,230,333 | 7/1993 | Yates et al. . | |
| 5,625,904 | 5/1997 | Kline | 2/239 |
| 5,651,142 | 7/1997 | Del Valle Mas | 2/239 |
| 5,664,263 | 9/1997 | Reynolds | 2/239 |

*Primary Examiner*—C. D. Crowder
*Assistant Examiner*—Larry D. Worrell, Jr.
*Attorney, Agent, or Firm*—Laubscher & Laubscher

[57] ABSTRACT

A circular knitting machine for knitting a sock having a pocket knitted integrally with the foot portion includes a needle cylinder carrying long and short butt needles, a drive train for oscillating the needle cylinder in a normal first mode and a second mode 180 degrees out of phase relative to the first mode, a pair of needle raising cams positionable so as to engage only the long butt needles during the knitting of the toe pocket, a lifter for holding the long butt needles in an up position during the knitting of the toe pocket, and a pair of stitch cam for engaging the needles to form the stitches. During the formation of the toe pocket, the short butt needles are pushed downwardly out of action below the knitting height while maintaining their stitches and the long butt needles are oscillated 180 degrees out of phase to form the toe pocket.

10 Claims, 10 Drawing Sheets

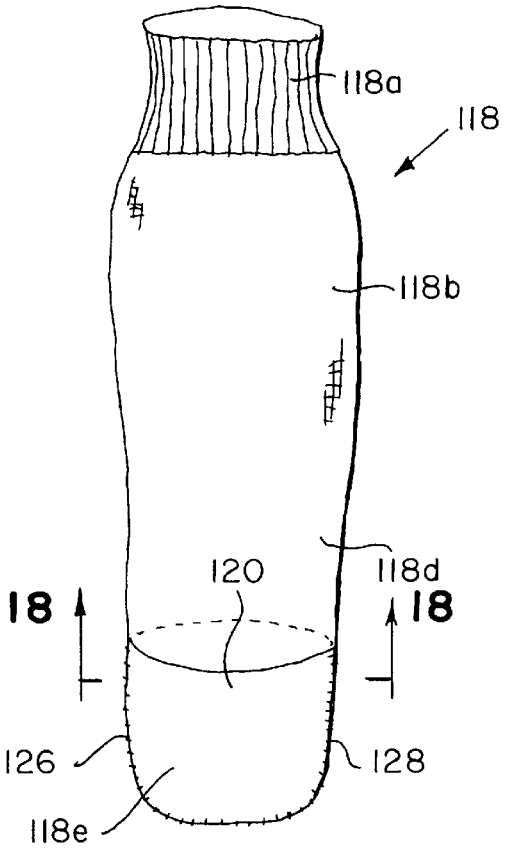
FIG. 16
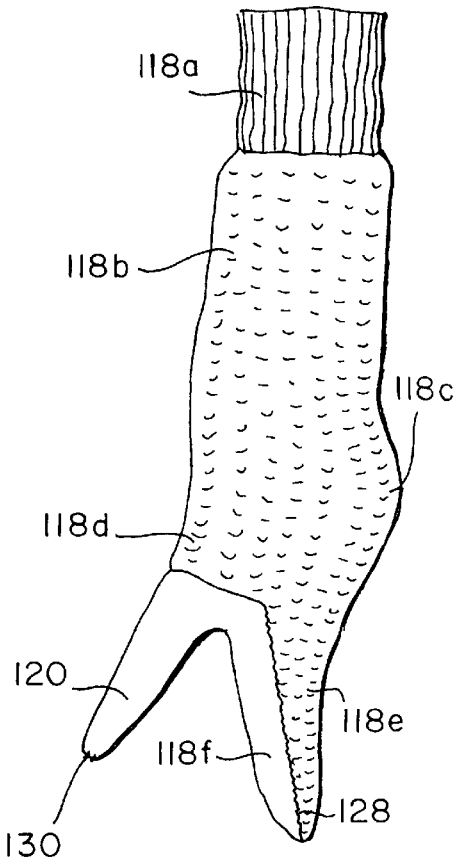
FIG. 17
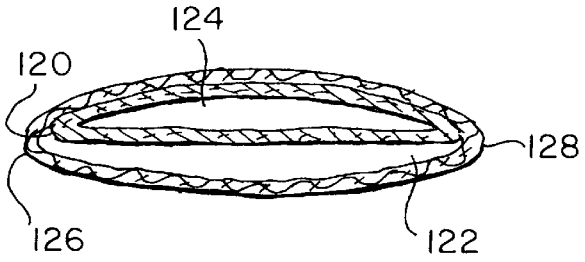
FIG. 18
FIG. 19
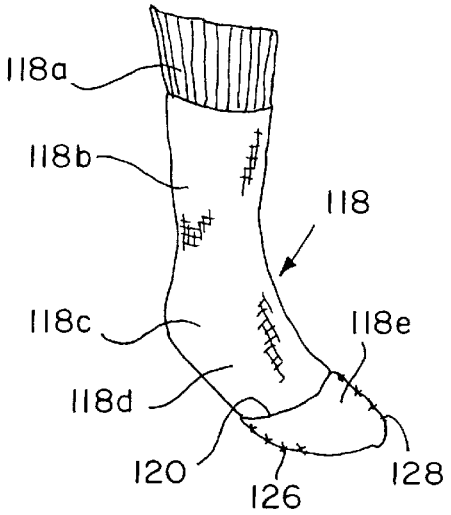

CIRCULAR KNITTING MACHINE FOR MAKING A SOCK WITH A KNITTED TOE POCKET

BACKGROUND OF THE INVENTION

The present invention relates to circular knitting machines and, more particularly, to a circular knitting machine for knitting a sock having a pocket knitted integrally with the foot portion of the sock for receiving a chemical heating pouch.

BRIEF DESCRIPTION OF THE PRIOR ART

Various circular knitting machines for knitting hosiery are known in the patented prior art. The Scott U.S. Pat. No. 1,152,850, for example, discloses an early version of a circular knitting machine for knitting stockings and the like. The Crawford U.S. Pat. No. 2,757,526 discloses a circular knitting machine for producing variegated triangular or rectilinear pattern areas (i.e. the "Argyle" design) in tubular fabric, such as in men's hosiery. The Crawford et al U.S. Pat. No. 3,181,313 discloses a circular knitting machine for knitting hosiery with plate and float patterns and the Crawford et al U.S. Pat. No. 3,605,446 discloses a circular knitting machine for producing socks having an upper cuff portion knitted of ribbed fabric while the sole portion is formed with terry loops. None of these knitting machines is capable of knitting a sock having a pocket knitted integrally with the foot portion of the sock.

Various socks having pockets are also known in the patented prior art. The Yates et al U.S. Pat. No. 5,230,333, which is owned by the same individuals as the present invention, discloses a thermal sock having a pocket on the top part of the foot portion of the sock for receiving a chemical heating pouch. The pocket is defined by a fabric layer that is secured to the sock by a U-shaped line of stitching. While the sewn-on pocket serves generally satisfactorily to contain the chemical heating pouch, there exists the need for a machine which can produce a sock having a toe pocket formed integrally with the sock, thereby eliminating the additional manufacturing step of individually sewing the fabric layer onto the sock to form the toe pocket.

The present invention was developed to overcome these and other drawbacks of the prior devices by providing an improved circular knitting machine capable of producing a sock with a toe pocket knitted integrally with the foot portion of the sock.

SUMMARY OF THE INVENTION

Accordingly, a primary object of the present invention is to provide an improved circular knitting machine capable of producing a sock with a toe pocket knitted as an integral part of the foot portion of the sock.

It is a more specific object of the invention to provide a circular knitting machine including a needle cylinder carrying a plurality of long and short butt knitting needles, a cylindrical gear sleeve arranged within the needle cylinder and connected thereto with a key, a pair of needle raising cam assemblies each including a pair of plungers for actuating a needle raising cam between a first intermediate position in which the cams engages only the long butt needles and a second fully actuated position in which the cams engage both the long and short butt needles, a pair of stitch cams for engaging the raised needles to form the stitches, a landing cam associated with each stitch cam for leveling the needles after they pass the stitch cams, a pair of lifter controls which hold corresponding left and/or right lifters connected with a center cam up, and a drive train including a left hand pinion having a pair of aligned radially extending slots which allow the needle cylinder to be oscillated in a first normal mode and a second mode 180 degrees out of phase with the normal mode during the knitting of the toe pocket. The machine is pneumatically operated and includes a computer controller for controlling the knitting of the sock.

During the knitting of the toe pocket, both needle raising cams are actuated to their intermediate positions so as to engage only the long butt needles which are thereby raised to the knitting height, and the needle cylinder is oscillated 180 degrees out of phase. This is accomplished by clutching the machine so that a projection on the clutch moves from the first slot contained in the left hand pinion to the second slot arranged 180 degrees opposite the first slot.

It is another object of the present invention to provide a circular knitting machine having a left hand lifter control for lifting an associated left hand lifter which holds the long butt needles up during knitting of the toe pocket.

It is a further object of the present invention to provide a method of knitting a sock having a toe pocket knitted as an integral part of the sock which includes the steps of forming the top rib portion and leg portions of the sock using the short and long butt knitting needles, forming the foot portion of the sock using the short and long butt needles, using the long butt needles to knit the toe pocket as an integral part of the foot portion of the sock, using the short and long butt needles to knit the remainder of the foot portion of the sock, using the short butt needles to knit the toe portion of the sock, and using the short and long butt needles to knit the clip portion of the sock. The sock is completed by further sewing the sides of the toe portion of the sock together, sewing the end of the toe pocket closed, and cutting away the excess clip portion of the sock.

It is yet a further object of the invention to provide a method of knitting a sock having an integrally formed knitted toe pocket which includes forming a heel portion into the sock using the short butt needles and forming the toe pocket into the top of the foot portion of the sock using the long butt needles.

BRIEF DESCRIPTION OF THE DRAWINGS

Other objects and advantages of the invention will become apparent from a study of the following specification when viewed in light of the accompanying drawings, in which:

FIG. 16 is a front plan view of a sock having a pocket knitted on the foot portion;

FIG. 17 is a side plan view of the sock turned inside-out with the toe pocket extended.

FIG. 18 is a cross-sectional view taken along line 18—18 of FIG. 16; and FIG. 19 is a perspective view of the sock.

DETAILED DESCRIPTION

Figure 1:
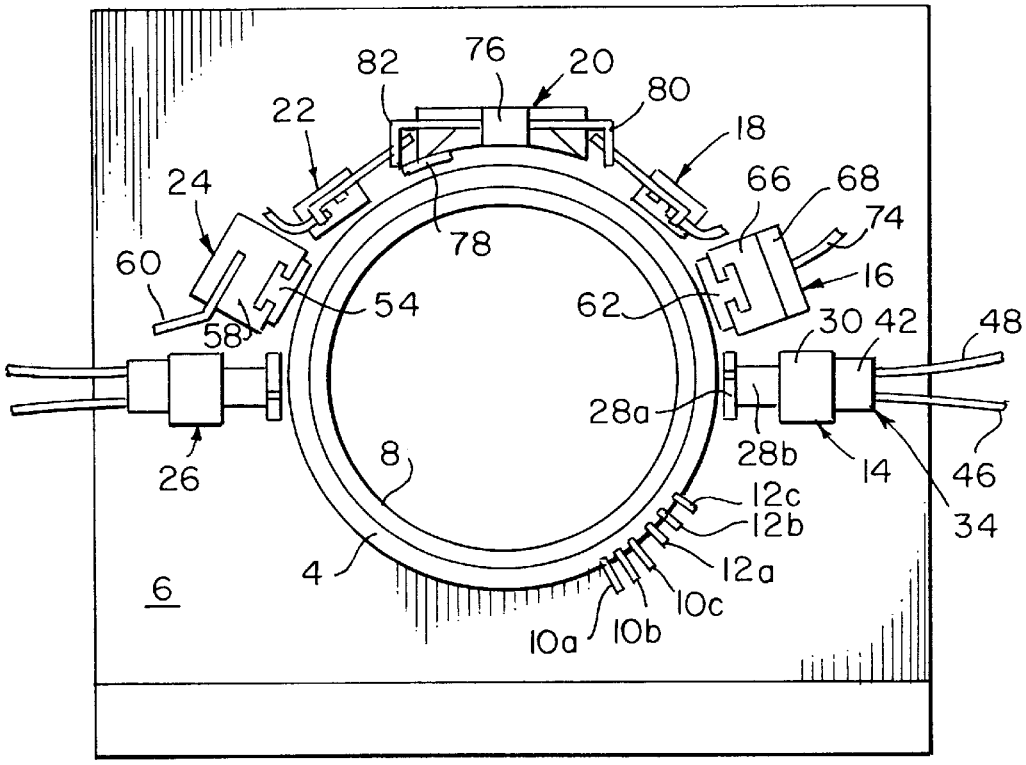
FIG. 1 is a top plan view of a circular knitting machine according to the invention.
Figure 2:
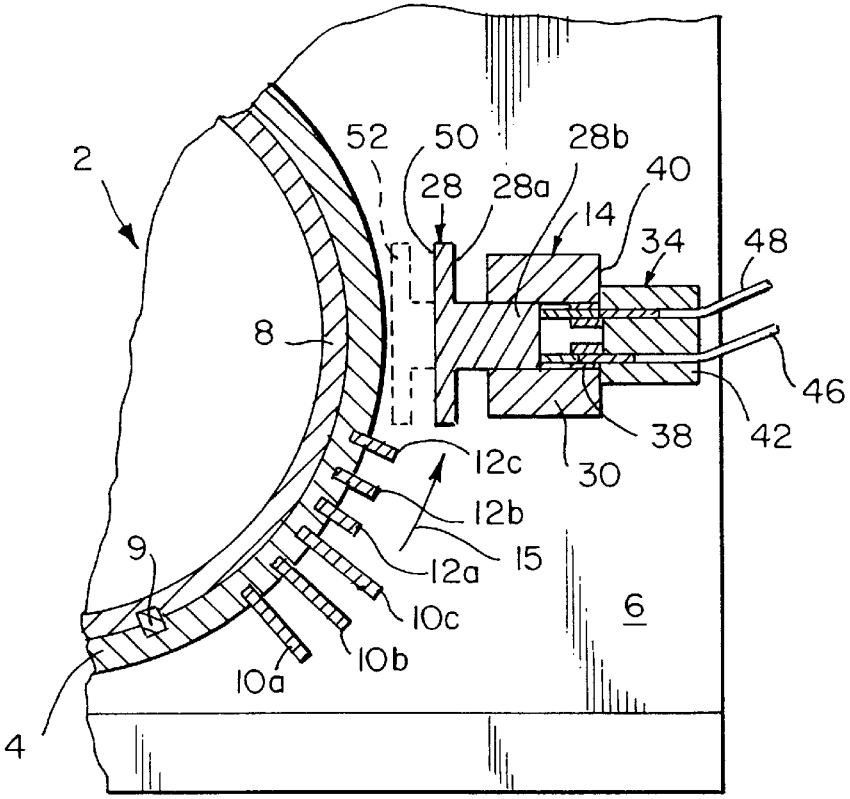
FIG. 2 is a detailed sectional diagrammic top view of the right side needle raising cam.
Figure 3:
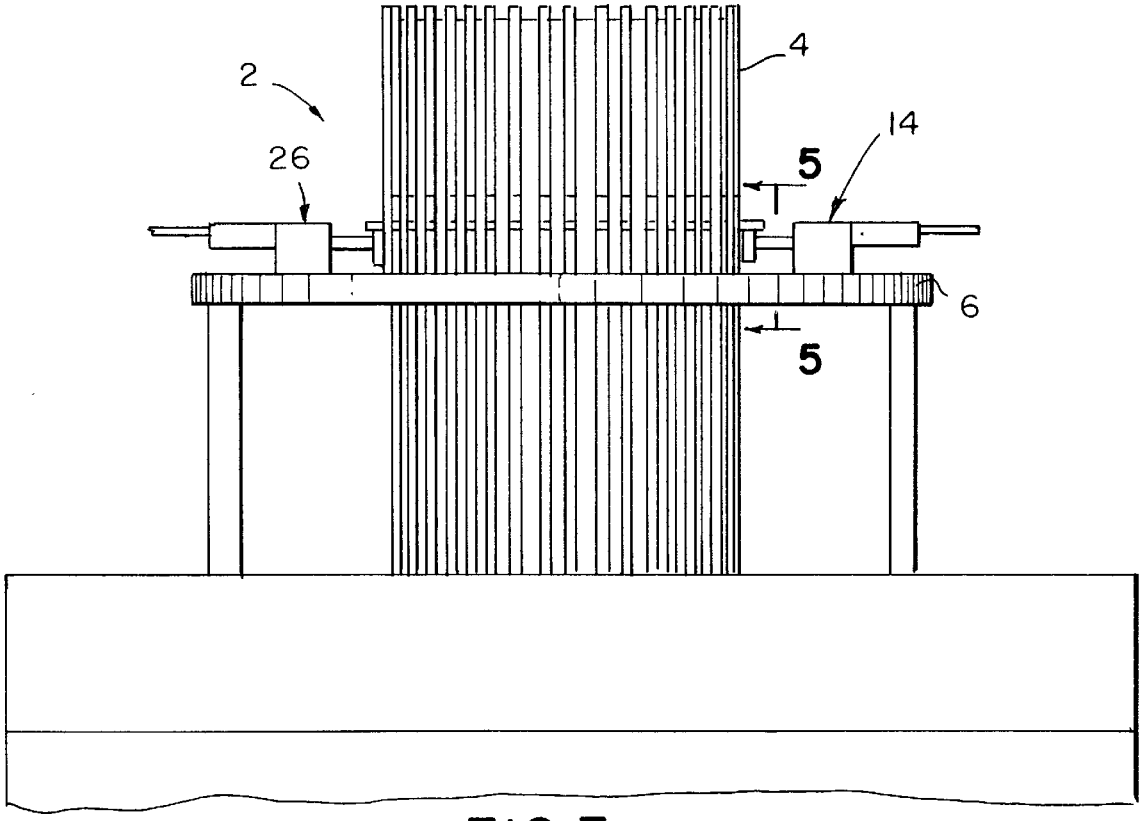
FIG. 3 is a front plan view of the circular knitting machine.

Referring first to FIGS. 1–3, there is shown a circular knitting machine 2 including a needle cylinder 4 rotatably arranged through a mounting table 6, and a cylindrical sleeve gear 8 arranged concentrically within the needle cylinder. The needle cylinder 4 and cylindrical sleeve gear 8 are keyed together via key 9 (FIG. 2).

The knitting machine is a modified version of the Concept 5 CVL knitting machine, a pneumatically operated, computer controlled knitting machine manufactured by Paramount-Crawford Technologies, Inc. of Kernersville, N.C. The present invention differs from the Concept 5 CVL knitting machine in the following ways, each of which will be described in greater detail below: (1) a second plunger has been added to both the right and left side needle raising cam controllers to allow the associated needle raising cams to move inwardly toward the needle cylinder to an intermediate position, thereby engaging only the long butt needles; (2) a second slot has been added to the left hand pinion to allow the clutch pinion to engage the left hand pinion at a position 180 degrees opposite the first slot, thereby allowing the needle cylinder to be oscillated 180 degrees out of phase; (3) a lifter controller has been added to the left hand lifter for holding the associated lifter in an up position which keeps the long butt needles up during the knitting of the toe pocket; (4) the landing cams for the left and right hand stitch cams have been modified; and (5) the computer for controlling the knitting machine has been modified to clutch the machine 180 degrees out of phase and actuate the various controllers to knit the toe pocket.

Figures 4A, 4B:
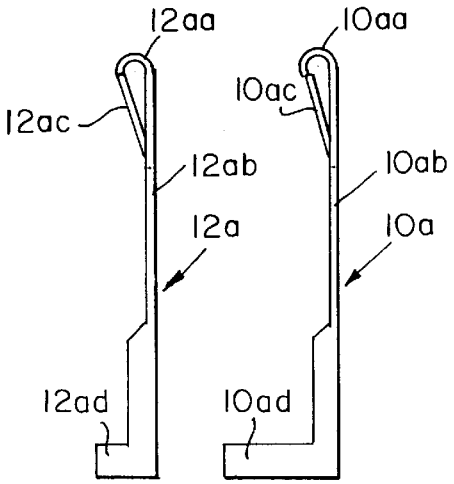
FIG. 4*a* is a side view of a long butt knitting needle.
FIG. 4*b* is a side view of a short butt knitting needle.

A plurality of long butt needles 10*a*, 10*b*, 10*c* and short butt needles 12*a*, 12*b*, 12*c* are slidably mounted on the outer circumference of the needle cylinder. For clarity, only three long and three short butt needles have been illustrated. However, the Concept 5 CVL knitting machine may include up to 84 such needles. A long butt needle 10*a* and short butt needle 12*a* are shown in FIGS. 4*a* and 4*b*, respectively. Each needle includes a hook portion 10*aa*, 12*aa*, respectively, a shank portion 10*ab*, 12*ab*, respectively, and a latch 10*ac*, 12*ac* pivotally connected with the respective shank portion. Each needle also includes either a long or short butt portion 10*ad*, 12*ad*, respectively, which extends perpendicularly from the bottom of the shank.

Figure 5:
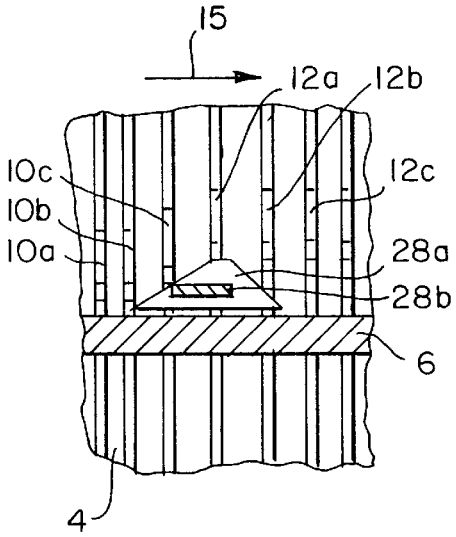
FIG. 5 is a sectional view taken along line 5—5 of FIG. 3.

A right hand side needle raising cam assembly or needle end cam assembly 14 is mounted on the mounting table 6 adjacent the needle cylinder 4 to selectively engage the long and/or short butt needles as the needle cylinder is rotated or oscillated, as indicated by arrow 15 in FIGS. 2 and 5.

A right hand stitch cam assembly 16 is mounted on the mounting table 6 adjacent the right hand needle raising cam 14 and a right hand lifter control 18 is mounted adjacent the right hand stitch cam assembly. A center cam and lifter block assembly 20 is mounted on the mounting table 6 at the back of the knitting machine between the right hand lifter control 18 and a left hand lifter control 22. A left hand stitch cam 24 is mounted adjacent the left hand lifter control 22 and a left hand needle raising cam assembly 26 is mounted on the mounting table adjacent the needle cylinder opposite the right hand needle raising cam 14.

Figure 6:
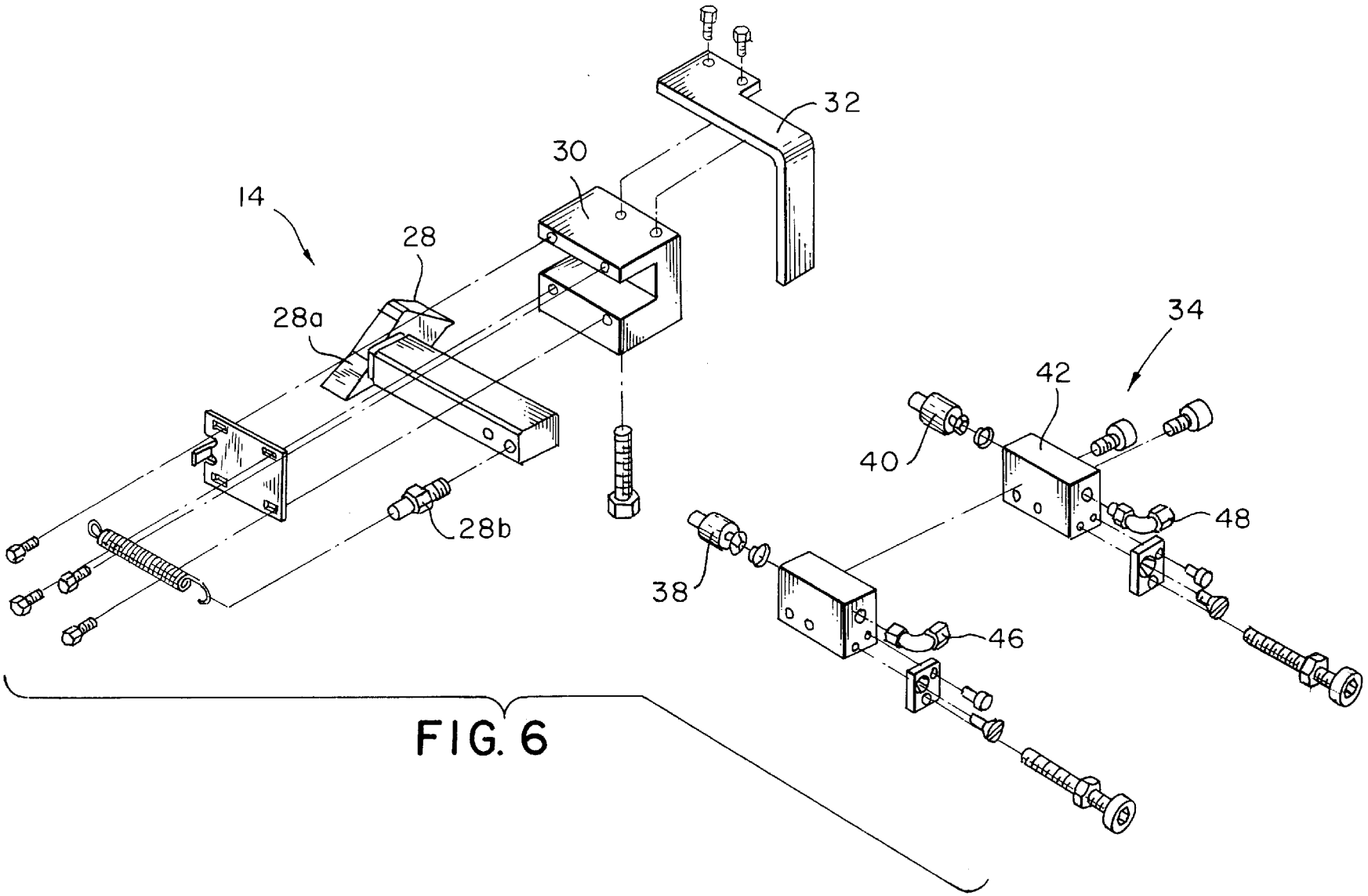
FIG. 6 is an exploded perspective view of a needle raising cam.

Referring now to FIGS. 2, 5, and 6, right hand needle raising cam assembly 14 includes a needle raising cam 28 having a cam portion 28*a* and an arm portion 28*b*, a cam mounting block 30, and a stop bracket 32 (FIG. 6). A pneumatically actuated needle raising cam controller 34 is connected with the mounting block 30 and serves to selectively move the cam 28 toward the needle cylinder.

Controller 34 includes a pair of air plungers 38, 40, a mounting block 42, and a pair of air supply lines 46, 48. As previously alluded to, the controllers of the original Concept 5 CVL knitting machine include only one plunger for actuating the associated needle raising cam. The present invention differs from the original Concept 5 CVL knitting machine in that a second plunger has been added to both the right and left side needle raising cam controllers to allow the associated needle raising cams to be actuated to an intermediate position.

As shown in FIG. 2, air plunger 38 serves to actuate needle raising cam 28 to the intermediate position 50. In this position, only the long butt needles 10*a*, 10*b*, 10*c* engage cam 28 and hence, only the long butt needles are raised to the knitting height. The short butt needles 12*a*, 12*b*, 12*c* do not engage the cam and therefore remain below the knitting height.

Air plunger 40, on the other hand, serves to actuate needle raising cam 28 to the fully extended position 52 shown in phantom. In this position, both the long and short butt needles engage the needle raising cam 28 and, hence, both are lifted to the knitting height.

The left hand needle raising cam assembly 26 is similar to the right hand needle raising cam 14 and is therefore not described in detail.

Figure 7:
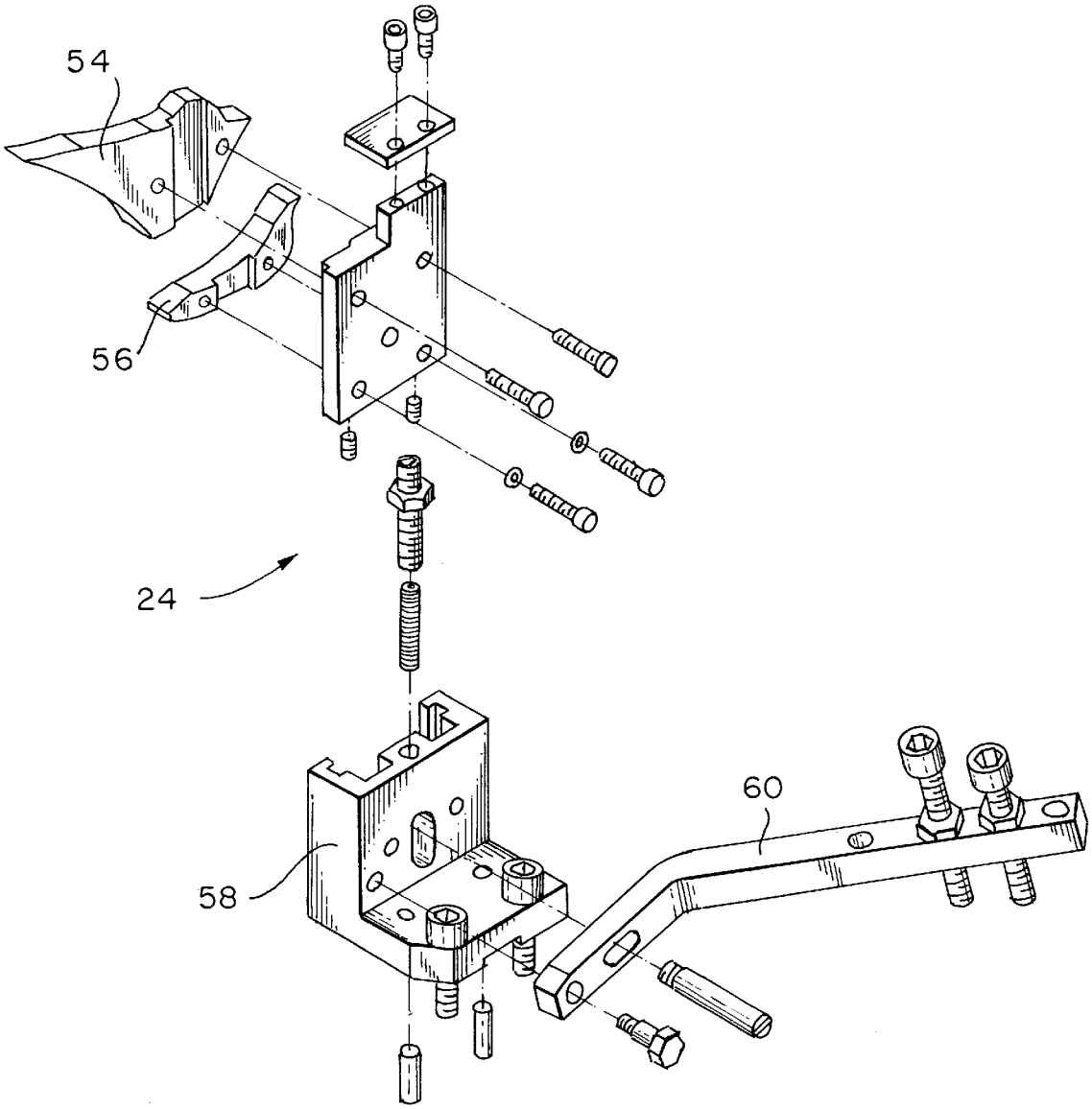
FIG. 7 is an exploded perspective view of the left hand side stitch cam/landing cam assembly.

FIG. 7 shows the left hand stitch cam assembly 24 including a left hand stitch cam 54 which engages the needle to form stitches, and a landing cam 56 which serves to level the needles after they pass through the stitch cam. The landing cams have been modified from the landing cams of the original Concept 5 CVL knitting machine to allow the pocket to be formed on the top of the foot portion of the sock. The left hand stitch cam also includes a mounting block 58, which is secured to the mounting table 6, and a control arm 60 which is connected with the mounting block 58.

Figure 8:
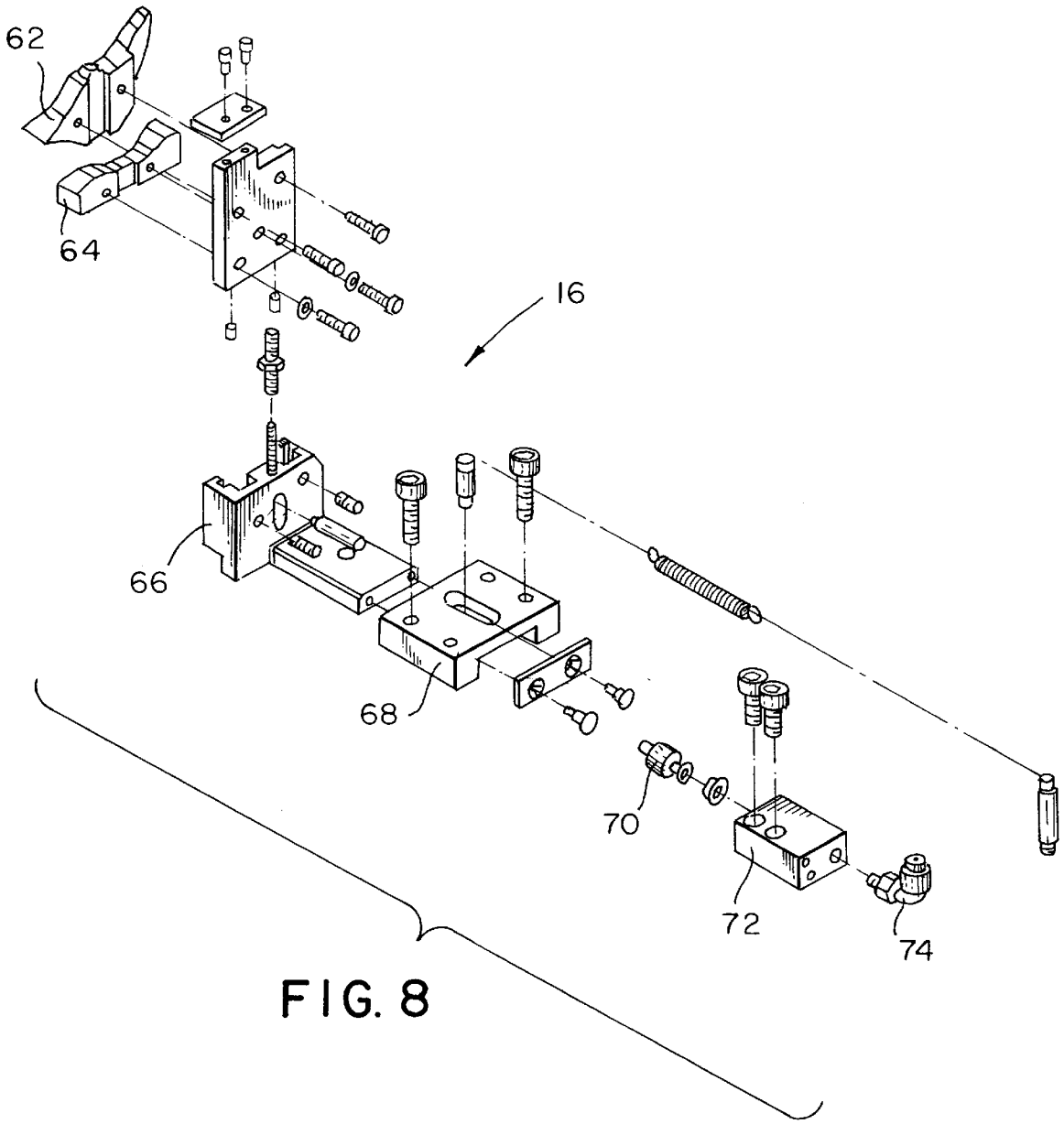
FIG. 8 is an exploded perspective view of the right hand side stitch/cam landing cam assembly

FIG. 8 shows the right hand stitch cam assembly 16 including a right hand stitch cam 62 which engages a needle to form a stitch, a modified right hand landing cam 64 for leveling the needles after they pass through the stitch cam, a cam slide 66 and cam slide cover 68. The right hand stitch cam assembly also includes a plunger 70, a plunger mounting block 72, and an air supply fitting 74 for pneumatically actuating the stitch cam 62.

Figure 9:
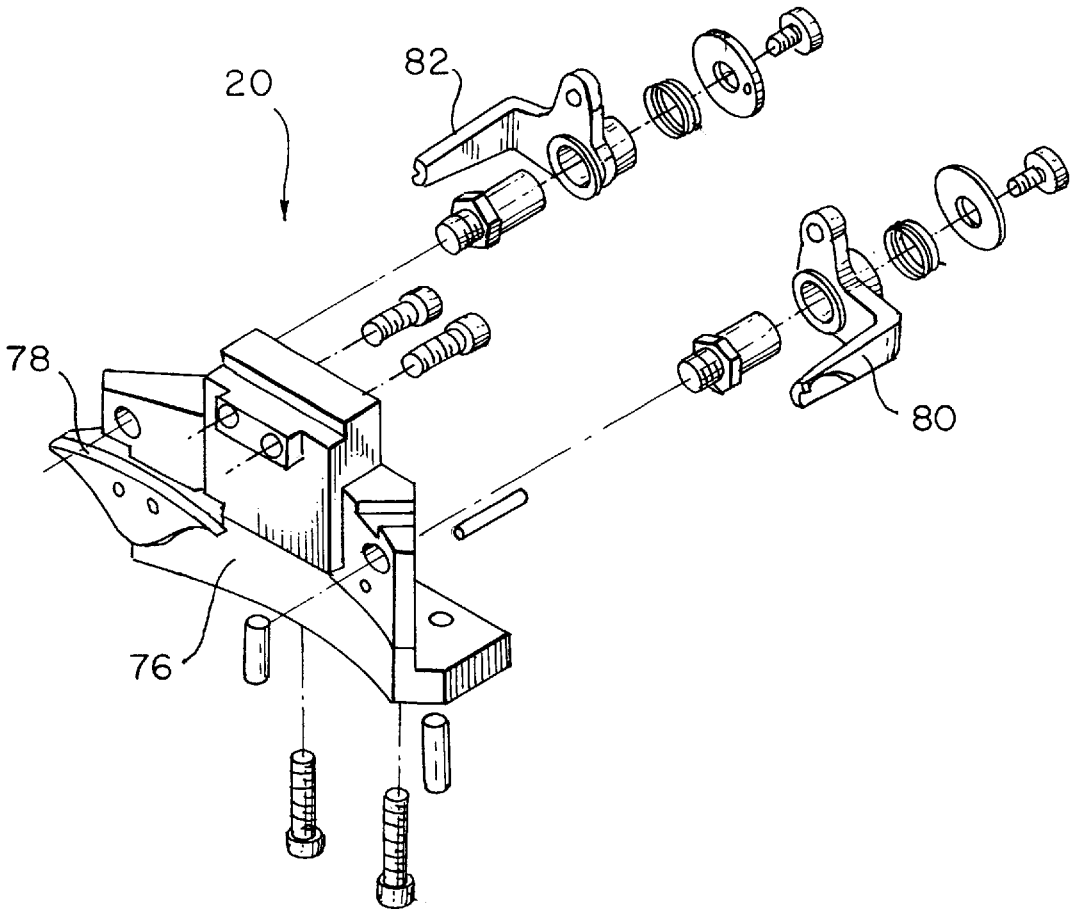
FIG. 9 is an exploded perspective view of the center cam.

FIG. 9 shows the center cam and lifter block assembly 20 of the Concept 5 CVL knitting machine including a center cam and lifter block 76, a stitch cam 78, a right hand lifter 80, and a left hand lifter 82. The center cam and lifter block assembly of the present invention is the same as the center cam and lifter block assembly in the original Concept 5 CVL knitting machine and has not been modified.

Figure 10:
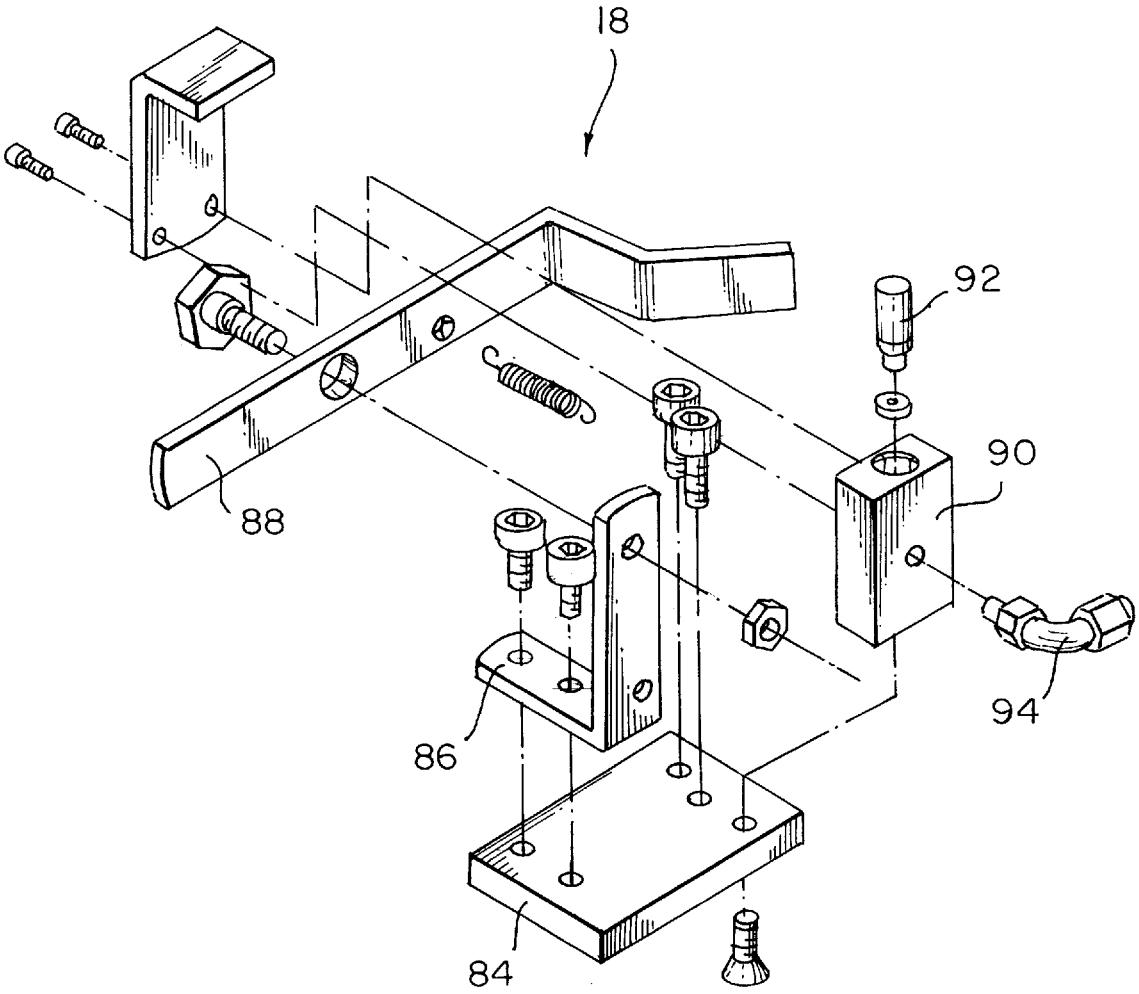
FIG. 10 is an exploded perspective view of a lifter control.

FIG. 10 shows the right hand lifter control assembly 18 including a mounting plate 84, a mounting bracket 86 connected with the mounting plate, and a lifter control arm 88 which engages right hand lifter 80. The lifter control assembly also includes an air plunger mounting block 90 which is mounted on the mounting plate 84, an air plunger 92 which is received in the air plunger mounting block 90, and an air supply fitting 94 which serves to pneumatically actuate the lifter control arm.

Right hand lifter control 18 is similar to the lifter control provided with the Concept 5 CVL knitting machine. The knitting machine of the present invention differs from the Concept 5 CVL knitting machine in that the Concept 5 CVL knitting machine includes a lifter control assembly on the right side only, whereas the knitting machine of the present invention includes lifter control assemblies on both the right and left sides. The left hand lifter control assembly 22 is similar to the right hand lifter control assembly 18 and will, therefore, not be described in detail. The left hand control assembly is needed to control the position of left hand lifter 82 during the formation of the toe pocket. In particular, the left hand control assembly serves to maintain the left hand lifter 82 in an up position which maintains the long butt needles in their up positions during the knitting of the toe pocket.

Figure 11:
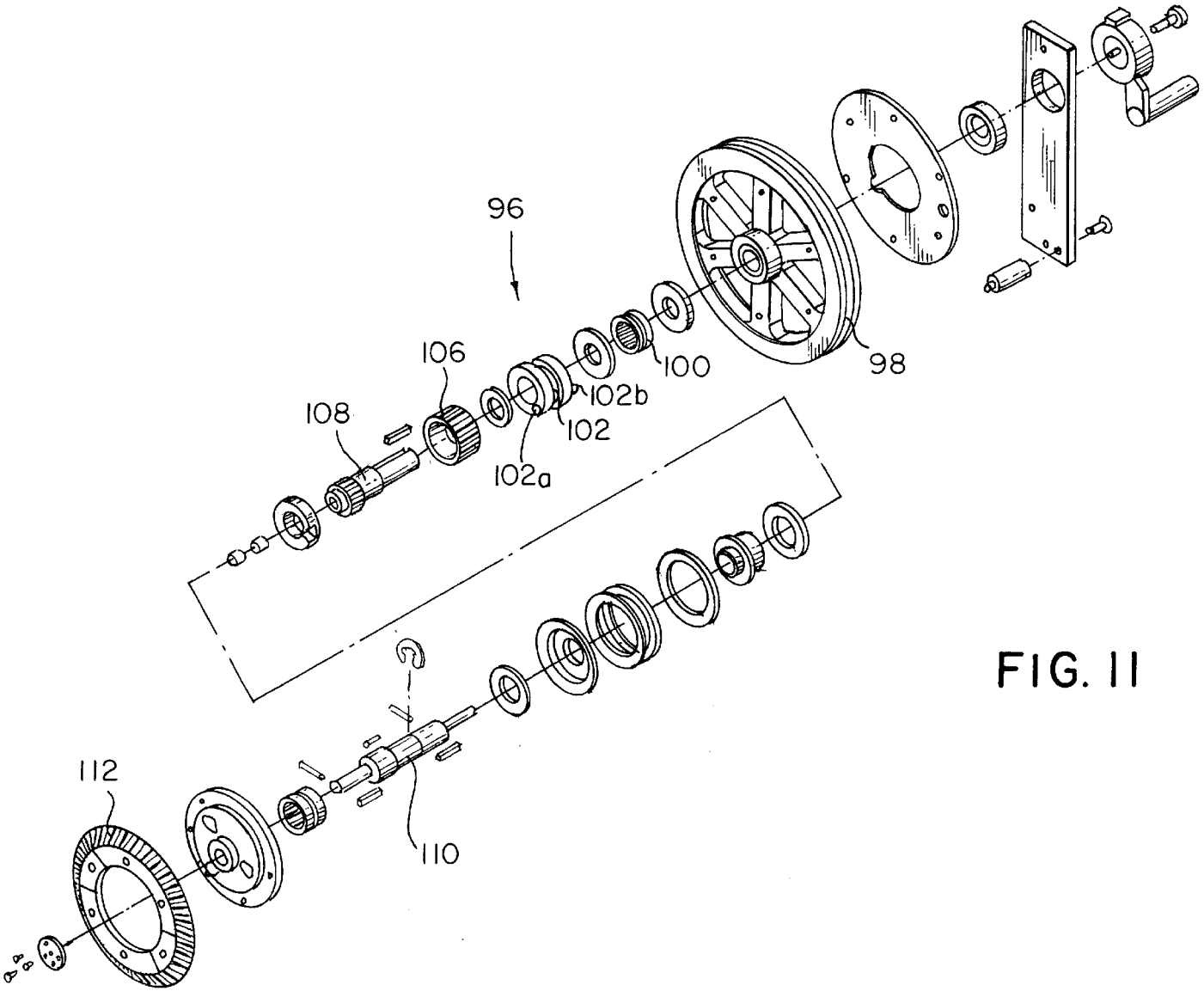
FIG. 11 is an exploded perspective view of the drive train.
Figure 12:
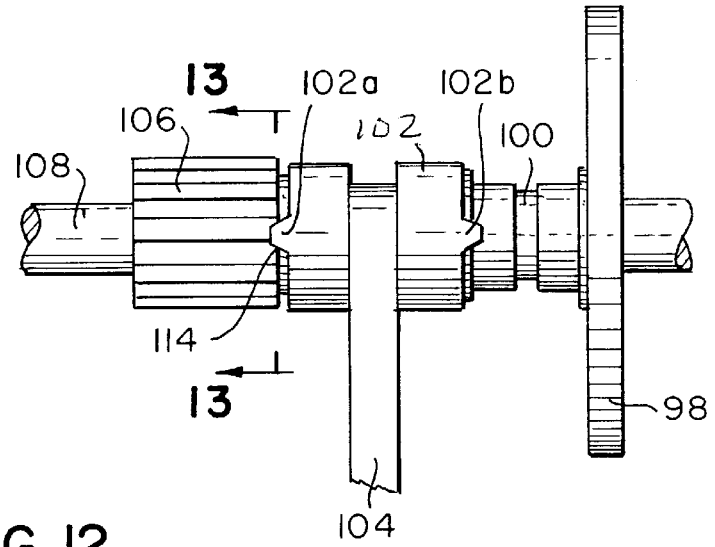
FIG. 12 is a side view showing the clutch pinion and left side pinion of the drive train.
Figure 13:
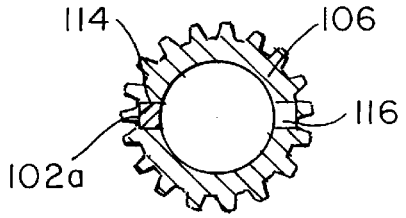
FIG. 13 is a sectional view taken along line 13—13 of FIG. 12.

Referring now to FIGS. 11–13, there is shown the drive train 96 of the knitting machine which has been modified from the Concept 5 CVL knitting machine to allow the needle cylinder 4 to be oscillated 180 degrees out of phase. The drive train includes a main drive pulley 98, a bearing 100, a clutch pinion 102 having a pair of oppositely extending projections 102*a*, 102*b*, a clutch arm 104 which actuates the clutch pinion 102, a left hand pinion 106, a right hand main shaft 108, a left hand main shaft 110, and a bevel gear 112 which drives the sleeve gear 8.

Figure 14:
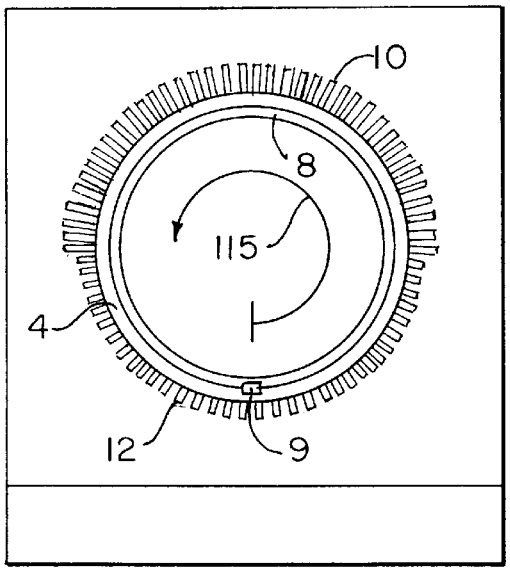
FIG. 14 is a top view illustrating the normal oscillation mode of the needle cylinder.
Figure 15:
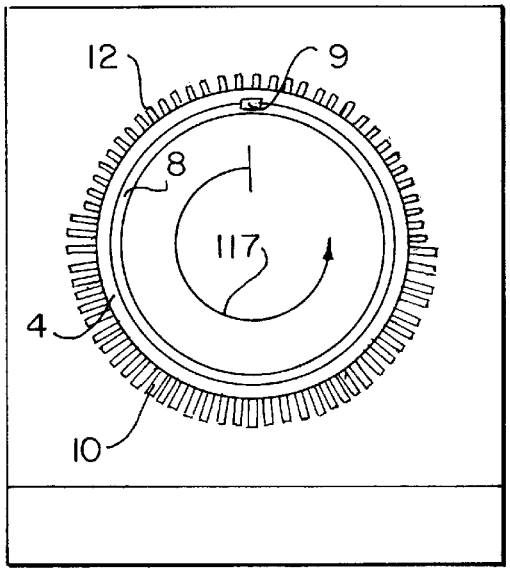
FIG. 15 is a top view illustrating the oscillation of the needle cylinder 180 degrees out of phase.

The drive train for the knitting machine of the present invention is similar to the drive train of the Concept 5 CVL machine except the left hand pinion 106 has been modified to include a pair of aligned radially extending slots 114, 116 (FIG. 13) for receiving projection 102*a*, whereas the Concept 5 CVL knitting machine includes only one such slot. Accordingly, the knitting machine can be clutched to allow the needle cylinder to oscillate in a normal mode shown in FIG. 14 and 180 degrees out of phase as shown in FIG. 15. In the normal mode, projection 102*a* engages slot 114. In this mode, as indicated by arrow 115, the period of oscillation begins at the front of the machine (as indicated by the point where the sleeve gear 8 and needle cylinder 4 are keyed together via key 9) and travels 360 degrees until the key is again located at the front of the machine. The direction of rotation is then reversed and repeated.

During the formation of the toe pocket, the needle cylinder is oscillated 180 degrees out of phase. This is accomplished by clutching the clutch pinion 102 so that projection 102*a* engages slot 116. In this mode, as indicated by arrow 117, the period of oscillation begins at the back of the knitting machine and the long butt needles 10 are initially positioned toward the front of the machine. This allows the long butt needles to be used to knit the toe pocket as an integral portion of the foot portion of the sock.

The needle cylinder 4 and sleeve gear 8 are similar to the needle cylinder and sleeve gear provided with the Concept 5 CVL knitting machine and are, therefore, not described in detail.

FIGS. 16–19 show a sock 118 containing a toe pocket 120 knitted as an integral portion of the sock. The sock includes a top portion 118*a* formed of a rib-type stitch, a leg portion 118*b* formed of a terry knit, a heel portion 118*c*, the heat pouch receiving toe pocket 120 formed of a flat knit, a foot portion 118*d*, and a toe portion 118*e*. Those of ordinary skill in the art will be recognize that the type of knit or stitch used to form the various portions of the sock may be varied. In addition, different types of socks, such as, for example, a tube-type sock may also be formed with the integral toe pocket.

The toe portion 118*e* defines a chamber 122 which contains the toe pocket 120 and further contains a space for the wearer's foot. The toe pocket defines a cavity 124 for receiving an oxygen activated chemical heating pouch (not shown) such as the MEDIHEAT product produced by Heatmax, Inc. of Dalton, Ga.

OPERATION

A sock having a knitted toe pocket is produced using the knitting machine by first forming the top rib portion 118*a* of the sock. This is accomplished by fully actuating the needle raising cams 14, 26 to their fully extended positions 52 toward the needle cylinder 4, actuating the stitch cams 54, 62 toward the needle cylinder, and running the needle cylinder in a straight run knitting with both the short and long butt needles. Next, the leg portion 118*b* is formed with a terry knit by also running both the long and short butt needles in a straight run as is known in the art. As indicated previously, different types of knits may be used to form the various portions of the sock.

The heel portion 118*c* is formed by pushing the long butt needles 10 up and out of action and oscillating the short butt needles over the needle raising cams and through the center cam and stitch cams. The right hand lifter control 18 is up and the lifter 80 picks up the short butt needles one at a time to the same height as the long butt needles. After a set number of needles are lifted, a dropper assembly (not shown) begins to push the needles back down before clutching into a straight run for the foot portion of the sock. After the heel portion 118*c* is formed, the foot portion 118*d* of the sock is knitted in the same manner as the leg portion 118*b*.

The toe pocket 120 is formed using only the long butt needles by (1) moving the needle raising cams 14, 26 to their intermediate positions, and (2) oscillating the needle cylinder 180 degrees out of phase. When the needle raising cams are in their intermediate positions, the short butt needles do not engage the cams and therefore remain down below the knitting height. Consequently, the short butt needles do not engage the stitch cams. While remaining below the knitting height and out of action and by not engaging the stitch cam or center cam, the short butt needles hold the last stitch knitted. The long butt needles, on the other hand, are raised to the knitting height by engaging the needle raising cams and subsequently engage the stitch cams, thereby forming the stitches which form the toe pocket.

The left hand lifter control assembly 22, which was added to the original Concept 5 CVL knitting machine, prevents any short butt needles from being picked up to the knitting height. The width of the toe pocket 120 is determined by the number of long butt needles used on the machine. Typically, the machine will have 42 needles, half the needles on the machine. The number of courses of fabric knitted is determined by the computer control system.

The needle cylinder is oscillated 180 degrees out of phase by actuating the clutch pinion 102 so that projection 102*a* moves from slot 114 to slot 116.

Once the toe pocket is formed, the machine is clutched back to its normal oscillation mode and the remainder 118*f* of the foot portion 118*d* is knitted. Last, the long butt needles are again pushed upwardly out of action and the short butt needles are oscillated to form the toe portion 118*e* in the same manner used to form the heel portion 118*c*.

Thus, during the formation of the heel and toe portions of the sock, the long butt needles are pushed upwardly out of action while the short butt needles are oscillated. During the formation of the toe pocket, the short butt needles are pushed downwardly out of action below the knitting height while the long butt needles are oscillated to form the toe pocket. Using the long butt needles to form the toe pocket requires clutching the machine 180 degrees out of phase while keeping the short butt needles down below the knitting height. The short butt needles must stay down while the long butt needles are oscillated. Otherwise, the stitch on the short butt needles will be cleared off the needles.

Once the sock has been knitted on the knitting machine, the sides of the foot remainder portion 118*f* and the toe portion 118*e* are sewn together forming seams 126, 128, and the end of the toe pocket 120 is sewn closed forming seam 130. The clip, which is the excess flat fabric after the toe, is then cut away.

While a sock having a foot portion 118*d* and a heel portion 118*c* has been described, it will be recognized that other types of socks, such as, for example, a tube sock, may also be formed. To form a sock without a heel portion, for example, the step in which the long butt needles are pushed up and out of action is eliminated so that the heel is never formed. This can be accomplished by simply modifying the computer controller. No alteration to the knitting machine itself is necessary.

While in accordance with the provisions of the Patent Statutes the preferred forms and embodiments of the invention have been illustrated and described, it will be apparent to those of ordinary skill in the art that various changes and modifications may be made without deviating from the inventive concepts set forth above.

What is claimed is:

1. A circular knitting machine for knitting a sock having a pocket knitted integrally with the foot portion of the sock, comprising (a) a rotatable needle cylinder including a plurality of long and short butt knitting needles slidably mounted thereon;

(b) a cylindrical gear sleeve arranged within said needle cylinder;

(c) key means arranged between said gear sleeve and said needle cylinder for rigidly connecting said gear sleeve and said needle cylinder;

(d) drive means connected with said gear sleeve for oscillating said gear sleeve in a first normal mode and a second mode 180 degrees out of phase with said first mode, (e) needle raising means for selectively engaging said long and short butt needles;

(f) lifter means for holding said long butt needles in an up position during the knitting of the pocket; and (g) stitch cam means for engaging said needles to form stitches.

2. Apparatus as defined in claim 1, wherein said drive means includes (1) a clutch pinion having a first surface containing a pair of aligned radially extending slots; and (2) a clutch pinion having a projection, said projection adapted to engage one of said slots.

3. Apparatus as defined in claim 2, wherein said needle raising means includes a pair of needle raising assemblies mounted on opposite sides of said needle cylinder, each assembly including (a) a needle raising cam movable between a first position for engaging said long and short butt needles and a second position for engaging said long butt needles only;

(b) a pair of plungers for actuating said needle raising cam between said first and second positions; and (c) means for individually actuating said plungers.

4. Apparatus as defined in claim 3, wherein said stitch cam means includes a pair of stitch cam assemblies each including a landing cam.

5. Apparatus as defined in claim 4, wherein said lifter means includes a pair of lifter assemblies and a pair of lifters, each said lifter assembly including a lifter arm for engaging an associated lifter.

6. A method for producing a sock having an upper leg portion (118*b*), a lower foot portion (118*d*), a toe pocket (120) knitted integrally with the foot portion, and a toe portion (118*e*), use being made of a circular knitting machine having short and long butt needles, which comprises the steps of:

(a) knitting a tubular first portion of the sock including the leg portion (118*b*) and at least a part of the foot portion (118*d*);

(b) knitting successively a tubular toe pocket (120) integral with a first part of the lower extremity of the sock foot portion, and a remainder foot portion (118*e*) integral with the toe pocket;

(c) knitting a toe portion (118*e*) integral with a second part of the lower extremity of the sock foot portion;

(d) sewing a seam (130) to close the end of the tubular toe pocket, thereby to define a cavity (124);

(e) sewing together by a pair of parallel seams (126,128) the associated edges of the remainder foot portion and the toe portion, respectively, thereby to define a toe-receiving chamber (122); and (f) reversely tucking the seamed toe pocket into the chamber, whereby the toe pocket cavity is arranged within the chamber for receiving a heat warming pouch.

7. The method for knitting a sock as defined in claim 6, which includes the steps of using both the long and short butt needles to knit the leg and foot portions of the sock, using only the long butt needles to knit the toe pocket portion (120) of the sock, using both the short and long butt needles to knit the remaining foot portion of the sock, and using only the short butt needles to knit the toe portion (118*e*) of the sock.

8. The method as defined in claim 7, and further including the intermediate step of knitting a heel portion (118*c*) between the toe and leg portions by use only of the short butt needles.

9. A knitted thermal sock, comprising:

(a) a knitted tubular leg portion (118*b*);

(b) a knitted foot position (118*b*) integral with the lower end of said leg portion;

(c) a tubular toe pocket portion (120) integral with the lower extremity of a first part of said foot portion, and an integrally knit remainder foot portion (118*f*) integral with said toe pocket portion;

(d) a toe portion (118*e*) integral with a second part of the lower end of said foot portion;

(e) a first seam (130) closing the free extremity of the toe pocket portion, thereby to define a cavity (124); and (f) a pair of further seams (126,128) sewing together corresponding side edges of said toe and remainder foot portions, thereby to define a toe-receiving chamber, whereby when the toe pocket portion is tucked inside the chamber, the cavity is arranged within the chamber to receive a heat warming pouch.

10. A thermal sock as defined in claim 9, wherein said sock is produced by a circular knitting machine having a plurality of short butt and long butt needles, said leg, foot and remainder foot portions being knitted by the use of both said long and said short butt needles, said toe pocket portion being knitted only by the use of said long needles, and said toe portion being knitted only by the use of said short needles.

* * * * *